United States Patent [19]

Kilroy

[11] 3,993,354

[45] Nov. 23, 1976

[54] MULTI-LEVEL HYDRAULIC MINING SYSTEM

[76] Inventor: Oliver B. Kilroy, 5 Calle Corta St., Tucson, Ariz. 85716

[22] Filed: May 16, 1975

[21] Appl. No.: 578,312

[52] U.S. Cl. ..... 299/19; 299/17; 299/18

[51] Int. Cl.[2] ..... E21C 35/20

[58] Field of Search ..... 299/17, 18, 19; 302/14, 302/15, 16

[56] References Cited

UNITED STATES PATENTS

| | | | |
|---|---|---|---|
| 3,260,548 | 7/1966 | Reichl | 299/18 |
| 3,790,214 | 9/1972 | Kilroy | 299/18 X |
| 3,870,373 | 3/1975 | Doerr et al. | 299/19 |
| 3,924,895 | 12/1975 | Leasure | 299/18 X |
| 3,942,841 | 3/1926 | McCain et al. | 299/18 X |

OTHER PUBLICATIONS

"Hydraulic Mining," Mitsui Mining Co., Ltd., 1972.

*Primary Examiner*—Ernest R. Purser
*Attorney, Agent, or Firm*—John A. Robertson

[57] ABSTRACT

A hydraulic mining system for a mine including a plurality of horizontal stopes each of which has a mining face. The apparatus comprises a main slurry mix tank at the lowermost stope, a hydraulic mining device in each stope, slurry forming mechanism in each stope for converting mined ore into slurry form, a flexible conduit extending from each stope to the main slurry mix tank for conveying mined ore in slurry form to the mix tank, an upflow tube having its lower end at said slurry mix tank and extending upwardly to the ground surface, and a pump for moving slurry upwardly in said tube.

8 Claims, 3 Drawing Figures

MULTI-LEVEL HYDRAULIC MINING SYSTEM

The present invention relates to hydraulic mining apparatus and is concerned primarily with apparatus intended for use in a multi-level mine having a plurality of stopes.

BACKGROUND OF THE INVENTION

In the patent to Kilroy, U.S. Pat. No. 3,790,214, there is disclosed a hydraulic mining system in which ore mined from the face of a stope is converted into a slurry and transmitted through a flexible conduit to a slurry mix tank in the stope. Water from an appropriate source is introduced into the slurry mix tank to achieve a proper consistency for pumping the slurry upwardly through a tube to the ground surface. In this patent there is no recognition of the fact that some mines include stopes at different levels. Thus the apparatus of this patent as such does not provide a simplified system for moving the ore mined from stopes of many levels upwardly through a single upflow tube.

In the patent, Reichl U.S. Pat. No. 3,260,548 there is disclosed coal mining apparatus in which a plurality of rooms are developed on a common level by a mining device. As the coal is mined it is converted into a slurry at the room being mined. This slurry is then conveyed through a tube to a slurry relay station which pumps the slurry to a desired location. Here again there is no suggestion that the mine includes a plurality of stopes at different levels nor that the slurry from each stope be combined in a mix tank at the lowermost level and pumped upwardly to the ground surface through an upflow tube.

OBJECTS OF THE INVENTION

With the foregoing conditions in mind the present invention has in view the following objectives:

1. To provide in a mine including a plurality of stopes at different levels and each of which has a mining face, apparatus for conveying mined ore in slurry form to a slurry mix tank at the lowermost stope and pumping the slurry through an outflow tube from the mix tank to the ground surface.

2. To provide, in apparatus of the type noted, mechanism in each stope for converting ore mined from the face of that stope to a slurry.

3. To provide, in apparatus of the character aforesaid, hydraulic mining mechanism in each stope for mining ore from the face thereof.

4. To provide in apparatus of the kind described in which the means for conveying slurry from a stope to the slurry mix tank at the lowermost level is a flexible conduit.

5. To provide, in apparatus of the type noted, a main slurry mix tank which is disassemblable whereby it is susceptible of being moved from the lowermost stope to one thereabove. Thus should the ore in the lowermost stope be exhausted mining operations would no longer be conducted therein and the mixing tank may be disassembled and erected in the stope thereabove to avoid the waste of energy involved in pumping the slurry upwardly.

Various other objects and advantages of the invention such as arise in carrying out the above ideas in a practical embodiment, will in part become apparent, and in part be hereinafter stated as the description of the invention proceeds.

SUMMARY OF THE INVENTION

The foregoing objects are achieved by providing apparatus which is adapted for installation in a mine including a plurality of stopes at different levels. The mine may be of the type in which the stopes enter the earth deposit from a vertical shaft or of the character in which the stopes enter the earth formation from the side of a hill or valley. Each of the stopes has a mine face from which ore is removed by appropriate mining mechanism. In a preferred embodiment of the invention this mechanism is hydraulic.

In each stope in the vicinity of the mine face thereof there is means for converting the ore into slurry. At the lowermost stope there is a main slurry mix tank and a flexible tube extending from the slurry converting means in each stope to the main slurry mix tank. Water is supplied to the main slurry mix tank to achieve a desired consistency or viscosity in the slurry which is desirable, if not essential, to remove the slurry from the mix tank by pumping it upwardly through an upflow tube which extends from the main slurry mix tank to the ground surface.

The main slurry mix tank is of a structure which renders it disassemblable. Thus it may be readily moved from the lowermost stope to one thereabove.

For a full and more complete understanding of the invention reference may be had to the following description and accompanying drawings wherein.

DESCRIPTION OF THE PREFERRED EMBODIMENT

Figure 1:
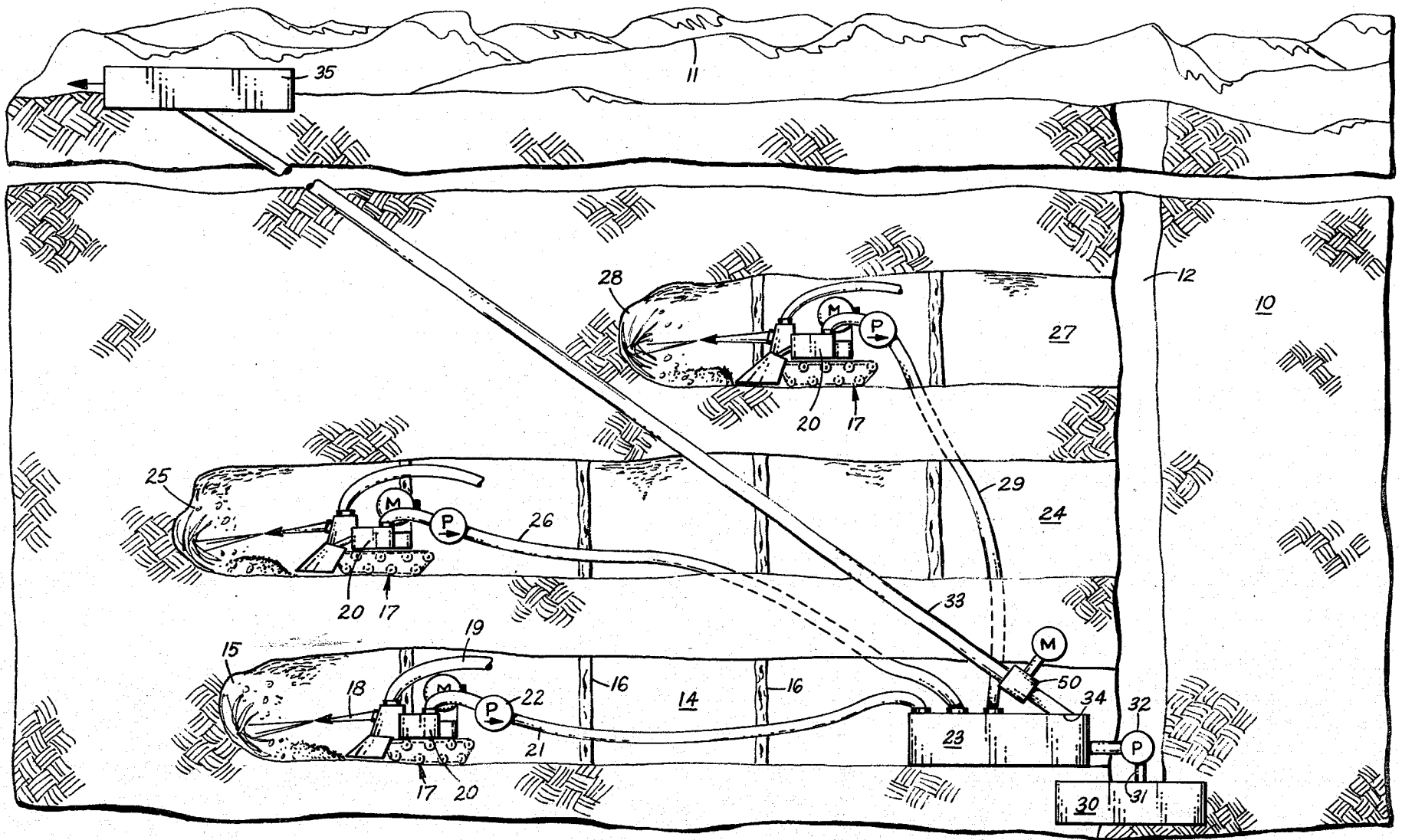
FIG. 1 is a side view partly in section and partly in elevation of one type of a multi-level mine with the apparatus of this invention installed therein.

Referring now to the drawings wherein like reference characters denote corresponding parts throughout the several views, and first more particularly to FIG. 1, a ground formation 10 presents a ground surface 11 from which a substantially vertical shaft 12 extends downwardly to the bottom of the mine which is represented at 13. A lowermost stope 14 enters the formation 10 on a substantially horizontal level from shaft 12 and is located slightly above mine bottom 13. Stope 14 has a face 15 from which ore is mined.

This mining may be accomplished by any of the conventional mining operations now employed. Thus while hydraulic mining mechanism is believed to be desirable, the use of explosives and mechanical devices are also contemplated as being within the purview of this invention. As stope 14 is formed it is supported by struts 16 in accordance with conventional practice.

Mining mechanism is designated generally 17 and in this illustrated embodiment is of the hydraulic type. Thus it includes one or more nozzles 18 which deliver water under pressure from a water line 19 to face 15 to remove ore therefrom. Line 19 is connected to any appropriate source of water under pressure. Mining mechanism 17 also includes a converter 20 which converts mined ore into a slurry in a well known manner. This slurry is passed through a flexible tube 21 under the influence of a pump 22 to a main slurry mix tank 23.

A second stope 24 enters the earth formation 10 from shaft 12 and presents a mine face 25. Hydraulic mining mechanism similar to that shown at 17 is positioned in stope 24 in close vicinity of face 25 and includes all of the elements described above in connection with mining device 17. However another flexible conduit 26 extends from the slurry converter 20 to main slurry mix tank 23.

Likewise, a third stope 27 enters the earth formation 10 from shaft 12 at a higher level and presents another mine face 28. Again a mining device 17 is located in stope 27 and another flexible conduit 29 extends from the converter 20 to the main slurry mix tank 23.

It is evident that slurry from each of the stopes 14, 24, and 27 is delivered to the main mix tank 23. As this slurry is to be pumped upwardly by mechanism to be later described, it is desirable that it have a consistency or viscosity which adapts it to such pumping action. Thus a source of water is indicated at 30 which may be located just above mine bottom 13 but this location is not a limitation on the invention as water may be supplied from any source. From reservoir 30 a pipe 31 extends to mix tank 23 and included therein is a pump 32.

An upflow tube 33 has its lower end in communication with mix tank 23 as indicated at 34 and its upper end enters into an ore separator 35 which is located at ground surface 11.

Figure 3:
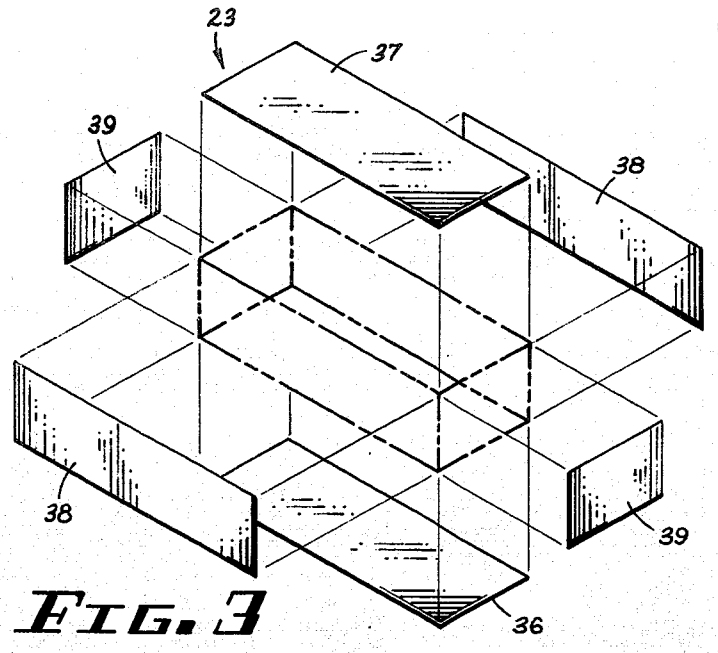
FIG. 3 is a perspective illustrating components of the main slurry mix tank in exploded relation.

It is intended that slurry mix tank 23 be disassemblable so that it may be removed from stope 14 when the latter becomes inactive to a stope thereabove such as stope 24. FIG. 3 illustrates one structural arrangement for rendering tank 23 disassemblable. Thus by way of example, tank 23 is shown as comprising a bottom 36, a top 37, side walls 38, and end walls 39 which are assembled in water tight relation in any well known manner. It is noted that top 37 and one of end walls 39 are illustrated diagrammatically and in this view the points of entry for conduits 21, 26, 29, upflow tube 33, and pipe 31 are not illustrated as such illustration would merely be confusing.

Figure 2:
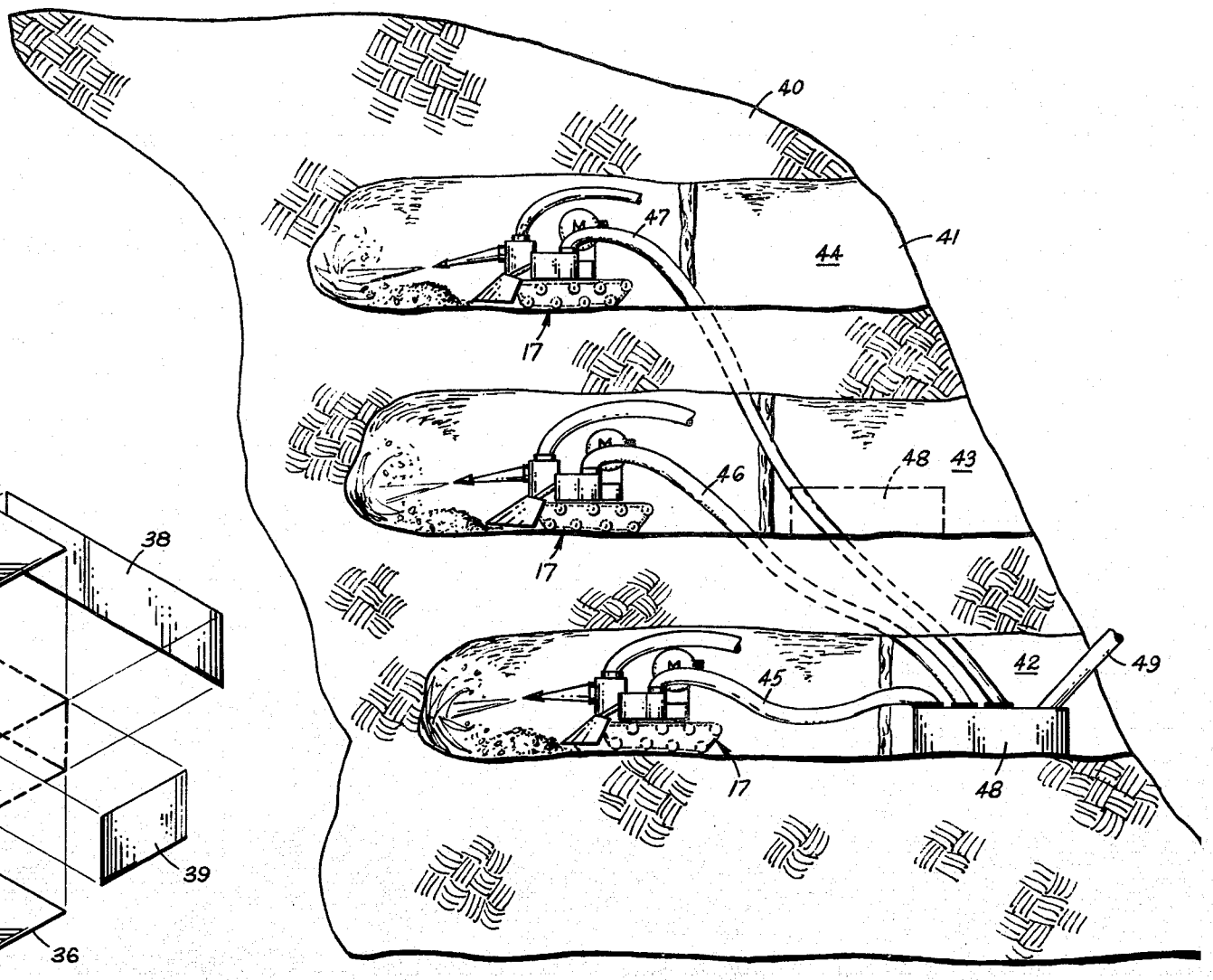
FIG. 2 is another side view partly in section and partly in elevation of a multi-level mine of another character.

Referring now to FIG. 2, another earth formation is designated 40 and presents a side surface 41 which may be the side of a hill or valley. Stopes 42, 43, and 44 enter the earth formation 40 from the face 41 which from its very nature has a vertical component. Each of these stopes presents a mine face and includes mining device 17 similar to those described in connection with FIG. 1. Flexible conduits 45, 46, and 47 extend from the converter for each of the mining devices 17 to a main mix tank 48 which is similar to the mix tank 23. From this mix tank 48 extends an outflow tube 49. Tube 49 will ordinarily have a vertical component whereby it constitutes an upflow tube. However due to the fact that the earth formation 40 is on the side of a hill or valley, tube 49 need not necessarily extend to the top of the hill. FIG. 2 depicts the tank 48 in broken lines in stopes 43 and 44 to indicate that it may be removed from stope 42 and installed in a stope thereabove.

OPERATION OF THE PREFERRED EMBODIMENT

While the mode of operation of the subject apparatus is believed to be obvious from the illustrations of the drawings and the description set forth above, it is briefly described as follows:

Ore is mined from the face 15, 25, and 38 of stopes 14, 24 and 27 respectively by the mining device 17 in each stope. It is converted into slurry form by the converter 20. Flexible conduits 21, 26, and 29 convey this slurry to slurry mix tank 23. It is imparted a desired consistency by the addition of water from reservoir 30 through pipe 31. It is then pumped upwardly through upflow tube 33 by a pump 50 to ground surface 11.

While preferred specific embodiments of the invention are hereinabove described it is to be clearly understood that the invention is not to be limited to the exact conditions, mechanisms, and materials illustrated and described because various modifications may be provided in putting the invention into practice.

What is claimed is:

1. For installation in a mine including a plurality of horizontal stopes at different levels which extend from a surface having a vertical component, with each stope presenting a mining face, apparatus comprising:

a. a mining device in each stope for mining ore from the face of that stope, b. mechanism in each stope for converting ore mined from the face of that stope into a slurry, c. a main slurry mix tank at the lowermost of said stopes, d. a flexible conduit extending from the converting mechanism in said lowermost stope to said main slurry mix tank and including a pump, e. a flexible conduit connected to the converting mechanism in each stope above said lowermost stope and including a pump adjacent to said converting mechanism and a portion that slants downwardly from said pump to said main slurry mix tank, f. a water supply for said slurry mix tank in the form of an underground reservoir, g. an outflow tube having its lower end communicating with said slurry mix tank; and h. a pump in said outflow tube for moving slurry therein.

2. The mining apparatus of claim 1 in which the mining devices are hydraulic.

3. The mining apparatus of claim 1 in which the surface having a vertical component is a bore surface of a vertical shaft which opens into a ground surface at the top of the shaft and the outflow tube is an upflow tube.

4. The mining apparatus of claim 3 in which said upflow tube extends to said ground surface.

5. The apparatus of claim 1 in which the surface with a vertical component is the side of a hill.

6. The apparatus of claim 1 in which the water supply is an underground reservoir together with a pipe extending from said reservoir to said main slurry mix tank and a pump included in said pipe.

7. The apparatus of claim 1 in which said main slurry mix tank is disassemblable whereby it is movable from the lowermost stope to a stope thereabove.

8. The apparatus of claim 7 in which said main slurry mix tank comprises a top, a bottom, side walls and end walls which are secured together in water tight relation and which are disassemblable.

* * * * *